US008689491B2

(12) United States Patent
Hamlin, III

(10) Patent No.: US 8,689,491 B2
(45) Date of Patent: Apr. 8, 2014

(54) DEVICE WITH INFLATABLE MEMBRANE FOR RAISING FLAT ROOF LOW AREAS

(76) Inventor: Henry Lee Hamlin, III, Forsyth, GA (US)

( * ) Notice: Subject to any disclaimer, the term of this patent is extended or adjusted under 35 U.S.C. 154(b) by 96 days.

(21) Appl. No.: 13/385,400

(22) Filed: Feb. 17, 2012

(65) Prior Publication Data

US 2012/0210651 A1 Aug. 23, 2012

Related U.S. Application Data

(60) Provisional application No. 61/443,830, filed on Feb. 17, 2011.

(51) Int. Cl.

| | |
|---|---|
| ***E04D 13/04*** | (2006.01) |
| ***E04D 11/02*** | (2006.01) |
| ***E04D 13/14*** | (2006.01) |

(52) U.S. Cl.

CPC ..... *E04D 11/02* (2013.01); *E04D 13/14* (2013.01); *E04D 13/0481* (2013.01); *E04D 13/1407* (2013.01)

USPC ..... 52/2.11; 52/2.17; 52/2.22; 52/2.24; 52/514; 52/741.4; 52/746.11; 52/745.21

(58) Field of Classification Search

USPC ..... 52/2.11, 2.17, 2.22, 2.24, 3, 58, 514, 52/515, 741.3, 741.4, 745.21, 746.11, 52/747.1

See application file for complete search history.

(56) References Cited

U.S. PATENT DOCUMENTS

| | | | | | |
|---|---|---|---|---|---|
| 3,807,100 | A | * | 4/1974 | Kuss | 52/2.11 |
| 3,958,373 | A | * | 5/1976 | Stewart et al. | 52/58 |
| 4,045,934 | A | * | 9/1977 | Sheahan et al. | 52/514 |
| 4,399,645 | A | * | 8/1983 | Murphy et al. | 52/2.11 |
| 5,259,879 | A | * | 11/1993 | Khattab et al. | 52/2.24 |
| 5,966,883 | A | * | 10/1999 | Krusec et al. | 52/746.11 |
| 6,006,482 | A | * | 12/1999 | Kelly | 52/409 |

* cited by examiner

*Primary Examiner* — Mark Wendell
*Assistant Examiner* — Matthew J Smith
(74) *Attorney, Agent, or Firm* — Harry I. Leon; Vivian L. Steadman

(57) ABSTRACT

A low cost method and device for diverting water away from a flat roof's low spots, thus preventing it from puddling there during a rainstorm. Such puddles, if allowed to stand, can damage a roof deck structurally. The device includes a flexible membrane, an air valve mounted thereon, and mechanical fasteners for attaching the membrane along its periphery, to both the roof deck and its existing covering. Ideally, the membrane can be heat welded, taped or glued to the roof covering and joined thereto to form an airtight seal, thus simplifying construction of inflatable barriers for the roof's low spots. For each such barrier, a membrane, sized and shaped to cover at least one low spot, substantially overlaps the latter's edges and defines, in combination with the roof covering, an air pocket which, when inflated via the air valve, causes the membrane to protrude upwardly, effectively elevating the covered spot.

5 Claims, 3 Drawing Sheets

DEVICE WITH INFLATABLE MEMBRANE FOR RAISING FLAT ROOF LOW AREAS

CROSS REFERENCE TO RELATED APPLICATION

This application is a non-provisional application of the earlier filed provisional application Ser. No. 61/443,830, filed Feb. 17, 2011, and claims the benefit of the priority of the filing date of Feb. 17, 2011, pursuant to 35 U.S.C. Sec. 119(e).

FIELD OF THE INVENTION

The present invention relates to a method and device for directing storm water once it has been captured on a flat or low-pitch roof toward the roof's drains and, more particularly, to an inflatable water resistant membrane forming a water repelling barrier for elevating a recessed area of such a roof.

BACKGROUND OF THE INVENTION

Drainage of flat and low-pitch industrial roofs is complicated by the fact that they typically have low areas where rainwater tends to pool. Pooled water, subject to frequent freeze/thaw cycles, not only stresses the roofing materials and the roof deck but also forms an environment where mosquitoes and other insects can breed and which nurtures the growth of mold and fungus.

Because the roof drains for a typical industrial flat roof are arrayed on 10 to 30 foot centers, low areas can often be found, interspersed between these drains. In order to fill in these low areas and direct storm water toward the drains, tapered roof insulation can be used. Unfortunately, installing tapered roof insulation is a very costly, time-consuming process, entails extensive application of glues formulated from hazardous materials, and generates a tremendous amount of waste.

SUMMARY OF THE INVENTION

The object of this invention is to provide a lightweight, inflatable barrier for directing storm water captured on a flat or low-pitch roof towards the roof's drains and, in the process, reducing or eliminating the formation of puddles of standing water on the roof.

A further object is to provide such a barrier for directing storm water captured on a low-pitch roof which both slopes toward an outside edge and is enclosed by a parapet wall, in such a way that the water can drain out of one or more scuppers formed in the parapet wall rather than pooling next to it.

A still further object is to provide a low cost method for effectively elevating a flat roof's recessed areas, with the portion of each recessed area so elevated encompassing the maximum extent to which storm water pooled in that particular recessed area can spread laterally, in any given direction, across the roof.

A still further object is to provide a method for effectively elevating the recessed areas of a flat or low-pitch roof in such a way that a person practising the method can easily adjust the drainage patterns as the roof ages and settles.

In accordance with the present invention, there is provided an inflatable barrier system which includes at least one air impermeable membrane fabricated from a heat weldable, thermoplastic material; an air valve attached to the membrane by a clamping mechanism which creates an airtight seal between the valve and the membrane; and means, including a mounting bracket, for mechanically fastening the membrane, along its outer periphery, to the roof deck.

For those roofs with an existing roof covering made of a material compatible with the membrane and to which it can be heat welded, only a single membrane, joined by an airtight seal to the roof covering, is needed in order to construct an inflatable barrier. In each such inflatable barrier, the single membrane must be adequately sized and shaped not only to cover at least one of the roof's individual recessed areas and substantially overlap its edges but also define, in combination with the roof covering, an air pocket which is so dimensioned that once inflated, the single membrane protrudes generally upwardly from the surface of the roof, thereby obscuring and effectively elevating the recessed area which the single membrane covers.

Alternatively, for those roofs having a roof covering to which the membrane cannot be heat welded, either because of the material properties of the roof covering or of the membrane itself, or of both, two further embodiments of the inflatable barrier system are provided. In the first of these, the system includes at least one membrane fabricated from a non-heat weldable material such as EPDM or the like. The process of joining a non-heat weldable membrane to an existing roof covering in such a way as to form an airtight seal at the membrane/roof covering juncture preferably entails juxtaposing a double-sided butyl tape—a tape of the sticky, rubbery variety—or the like between the roof covering and the membrane by first affixing one of the tape's sticky sides to the roof covering proximate with the outer edges of a recessed area on the roof and then affixing the membrane to the tape's other sticky side. Glues, adhesives, and/or solvents can also be used in place of the double-sided butyl tape to achieve an airtight seal at the membrane/roof covering juncture.

For those roofs having a roof covering to which the membrane cannot be joined either by heat welding or by the use of a double-sided butyl tape, adhesives in general or the like, the inflatable barrier system preferably comprises at least one pair of membranes, each of which is in the form of a single layer of a heat weldable, thermoplastic material, with the membranes in each pair having generally the same shape and size.

The improved method for redirecting storm water captured on a flat or low-pitch roof towards the roof's drains includes the following steps:

1) Removing any water standing in the roof's recessed area(s);
2) Cutting at least one membrane in the form of a single layer of a heat-weldable, thermoplastic material to a size and shape which allows the installer not only to cover at least one recessed area with the membrane but also to create, proximate with its outer periphery, an airtight seal between the membrane and the existing roof covering, whenever the latter is made of a heat-weldable, thermoplastic material compatible with that of the membrane;
3) Attaching an air valve to the membrane and, in the process, forming, an airtight seal between the valve and the membrane;
4) Heat welding the membrane to the existing roof covering when both it and the membrane are made of compatible heat-weldable materials, the heat welding being carried out in such a way as to create both an airtight seal and an air pocket, the airtight seal being formed proximate with the membrane's outer periphery and the air pocket, which is defined by the membrane and the existing roof covering, being disposed inwardly of the airtight seal;

5) Mechanically fastening the membrane to the roof deck; and
6) Inflating the air pocket with compressed air or the like introduced via the air valve until the membrane protrudes generally upwardly, thereby effectively elevating the recessed area which the membrane covers.

For inflatable barrier systems having at least one membrane made of a non-heat weldable material, the joining of the membrane to the roof covering, preferably achieved with the use of a double-sided butyl tape or the like, creates both an airtight seal, at the membrane/tape/roof covering interface, and an air pocket. Defined by the membrane and the roof covering, the air pocket is disposed inwardly of the airtight seal. Once the membrane's outer perimeter has been mechanically fastened to the roof deck, the air pocket is then inflated with the use of an air valve mounted earlier on the membrane, and prior to its having been affixed to the roof covering.

The improved method for redirecting storm water is likewise modified in those situations in which a pair of membranes, each a single layer of a heat weldable, thermoplastic material, are heat welded together to form an inflatable barrier. There the two membranes share both the airtight seal, which is formed proximate with the perimeter of at least one of them, and the air pocket. Inflation of the latter is accomplished, using an air valve mounted earlier on one of the membranes, once the conjoined membrane pair has been mechanically fastened to the roof deck.

DETAILED DESCRIPTION OF THE PREFERRED EMBODIMENTS

Figure 1:
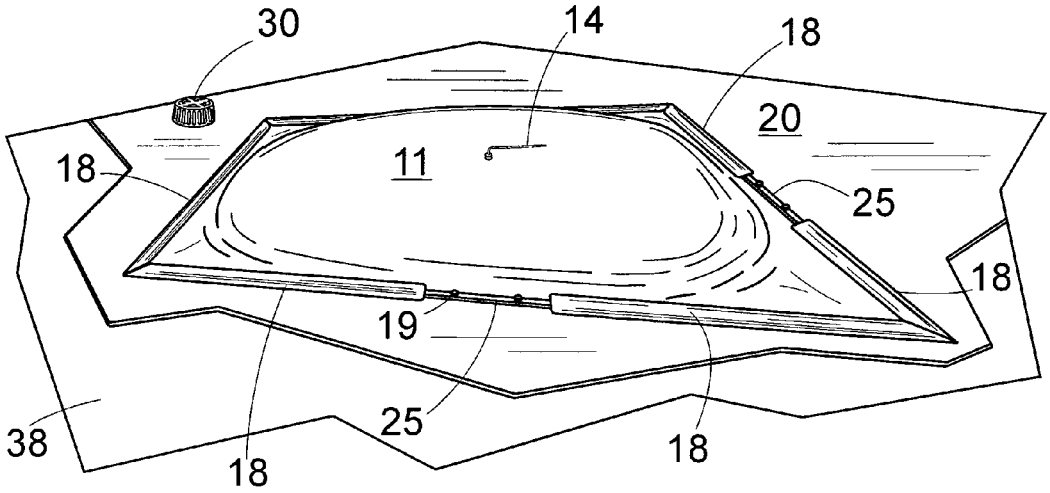
FIG. 1 shows a top perspective view of the inflatable barrier system according to the present invention, only fragmentary portions of a protective covering for brackets used to fasten the inflatable barrier to the roof deck being shown.

In the drawings, two basic embodiments of the inflatable barrier system according to the present invention are illustrated. These embodiments differ from each other in whether they utilize one air impermeable membrane 11, in combination with an existing roof covering 20, or two such membranes 11, 12 in order to create an inflatable air pocket 21, 22. Regardless of the number of membranes 11, 12, each membrane is preferably in the form of a single layer of a heat weldable, thermoplastic material. In either basic embodiment, once the inflatable barrier system has been assembled and mechanically fastened to the roof, covering at least one recessed area 10, and the air pocket 21, 22 has subsequently been inflated, a membrane 11, protruding generally upwardly from the roof's surface, effectively elevates the recessed area and redirects any storm water captured nearby to flow away from it and towards the roof's drains 30, 31 (FIGS. 1-6).

Prior to the installation of the inflatable barrier system, pooled water, if present, is pumped out of the recessed area 10 or otherwise dried using a mop or the like. A heat weldable, thermoplastic material such as the Carlisle TPO Sure-Weld from which the membrane 11 is to be cut is then laid out on the roof covering 20 so that the material not only substantially overlaps the recessed area's outer edges but also is oriented in such a way that when the yet-to-be created air pocket 21, 22 is properly inflated, water which would otherwise stand in the recessed area 10 will move instead toward a drain 30, 31. The membrane material is next cut to a size larger than the recessed area 10 in preparation for forming an airtight seal around the recessed area's perimeter between the membrane 11 and any existing thermoplastic roof covering 20, as well as an air pocket 21, 22 disposed inwardly of the airtight seal.

If, however, the nature of either the roof covering 20 or the membrane 11 itself is such that the membrane cannot be heat welded to the roof covering, the membrane can be joined thereto in such a way as to form an airtight seal 17 at the membrane/roof covering juncture with the use of a double-sided butyl tape (not shown) juxtaposed between the roof covering 20 and the membrane 11. Glues, adhesives, and/or solvents can also be used in place of the double-sided butyl tape to form an airtight seal 17.

Alternatively, a second membrane 12, preferably similar in shape and size to the membrane 11, can also be fabricated. With the membrane 12 juxtaposed between the membrane 11 and whatever covering 20 is present on the roof deck 38 or 40, the paired membranes 11, 12 are then heat welded or otherwise conjoined to form both an airtight seal 17, disposed proximate with the perimeter of at least one of them, and an air pocket 21, 22 (FIGS. 3-6).

Figure 3:
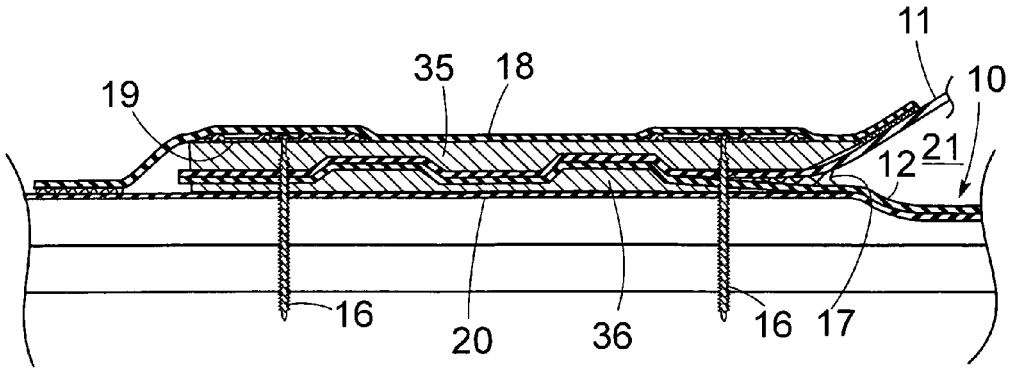
FIG. 3 is a cross-section, on an enlarged scale, of a fragmentary portion of an inflatable barrier system according to the present invention, the barrier system including a pair of membranes which have been heat welded together along their respective outer edges so as to form a common joint and then pressed, proximate with this joint, between the interlocking components of a mounting bracket mechanically fastened to the roof deck.
Figure 4:
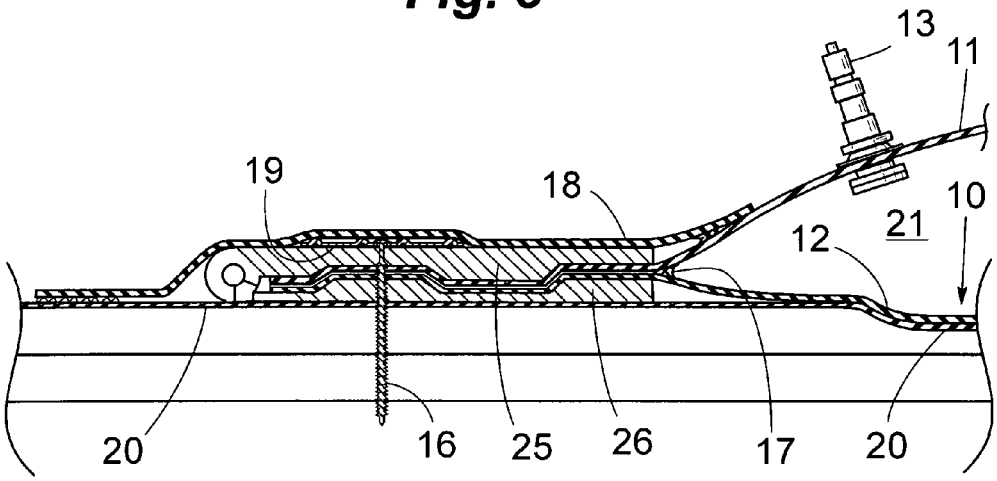
FIG. 4 is a cross-section, on an enlarged scale, of a fragmentary portion of the inflatable barrier system according to FIG. 3, except an alternate embodiment of the mounting bracket is depicted and an air valve which extends generally perpendicularly to the exterior surface of the system's exposed membrane is shown.
Figure 5:
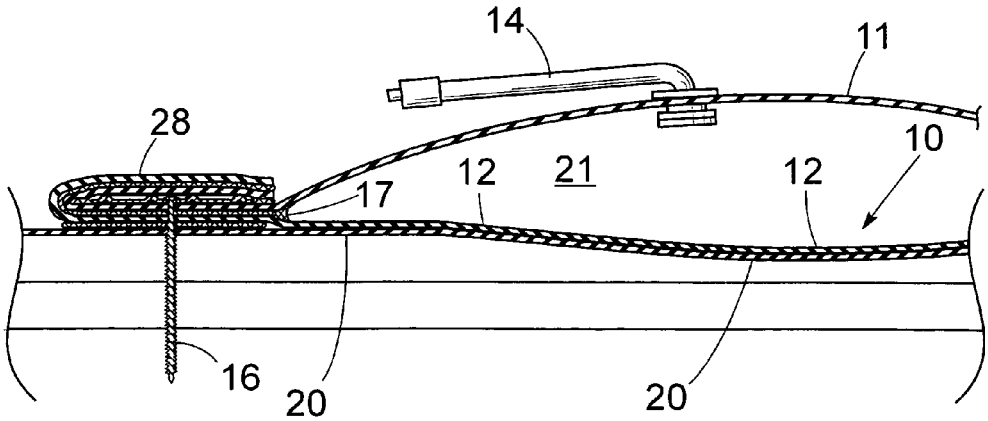
FIG. 5 is a cross-section, on an enlarged scale, of a fragmentary portion of the inflatable barrier system according to FIG. 3, except a further alternate embodiment of the mounting bracket—one which lacks interlocking components—is shown and an elbow-shaped air valve is depicted.

Before the installer actually heat welds or otherwise joins the membrane 11 to the roof covering 20 or, alternately, to a second membrane 12, it is recommended that he first mount a Schroeder-type air valve or the like, such as a straight air valve 13 or an angled air valve 14, on the membrane 11 (FIGS. 3 and 4). For accessibility, the air valve 13, 14 must be mounted on the assembled inflatable barrier system in such a way that the air valve protrudes outwardly therefrom. In addition, the air valve preferably includes a clamping mechanism with a plate which, when it is clamped against the membrane 11, creates an airtight seal about the valve. The valve 13, 14 may be further attached to a source (not shown) of compressed air in order to maintain a constant air pressure within the air pocket 21, 22 and thereby stabilize the inflatable barrier on a long-term basis, preventing its collapse into the recessed area 10.

Figure 2:
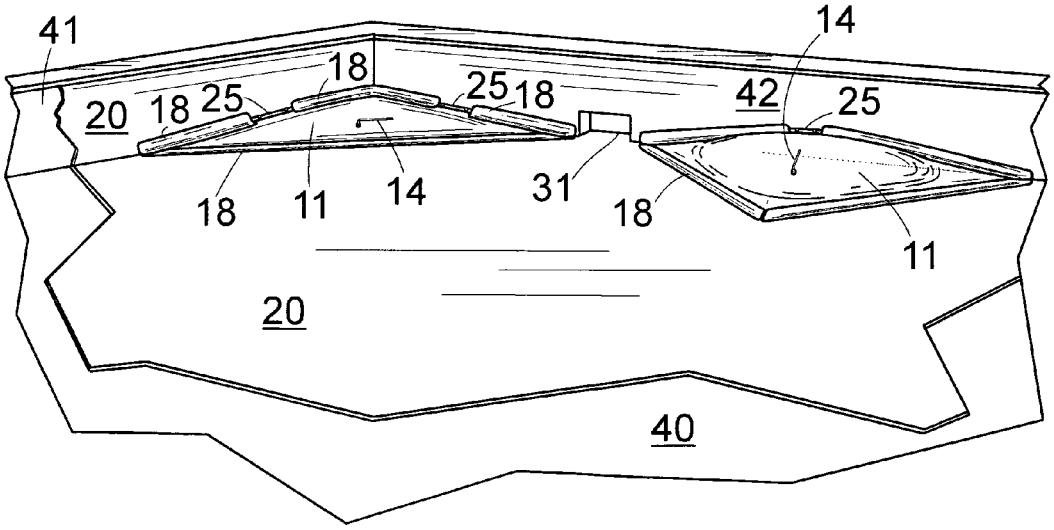
FIG. 2 shows a pair of inflatable barrier systems according to FIG. 1, which are positioned on either side of a scupper formed in a parapet wall, each barrier system having an exposed membrane with first and second portions mechanically fastened to the roof deck and to the parapet wall, respectively.
Figure 6:
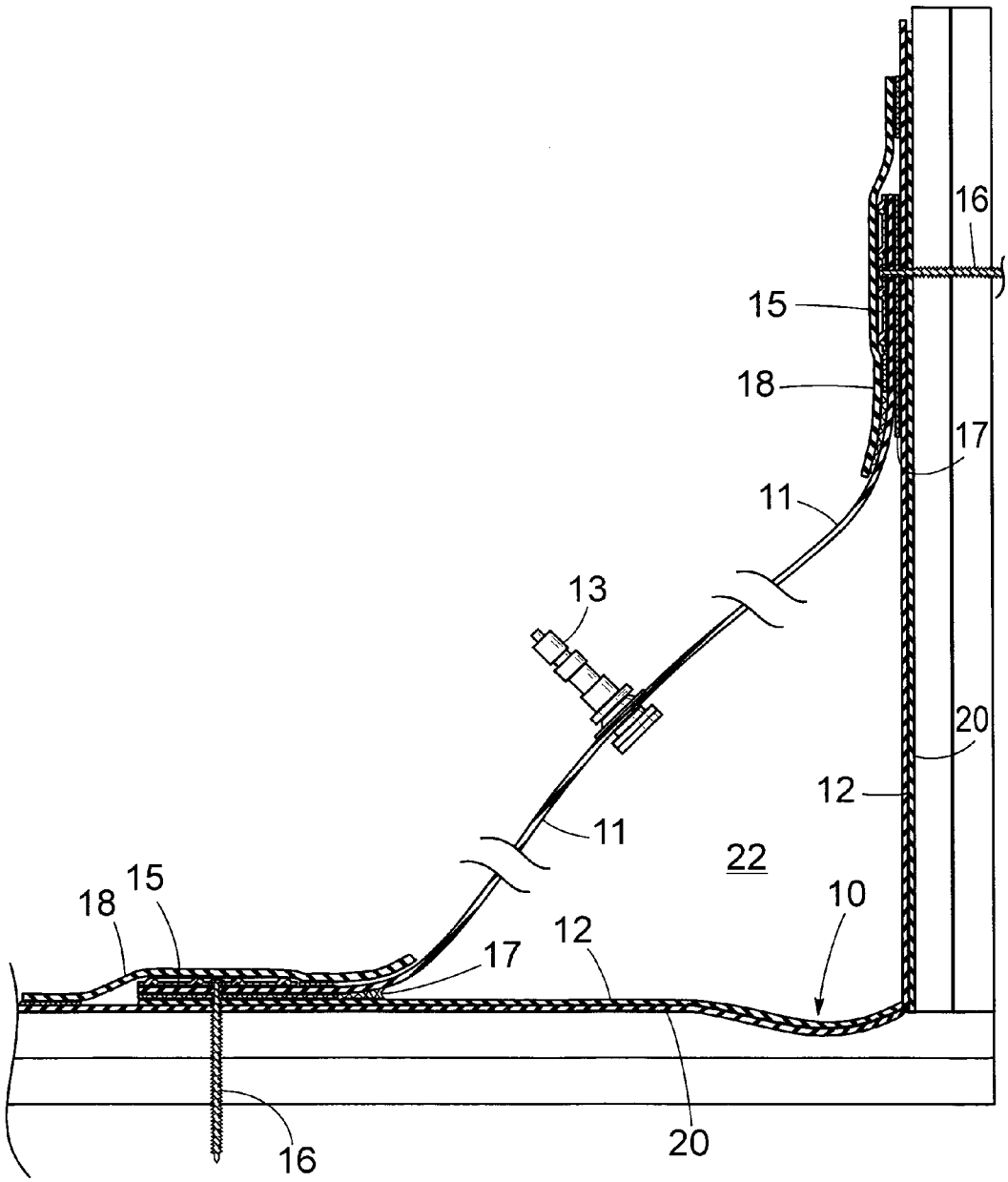
FIG. 6 is a cross-section, on an enlarged scale, of a fragmentary portion of an inflatable barrier system according to the present invention, the barrier system being used as a corner cricket to bridge a recessed area between a roof and a parapet wall, the barrier system including a pair of membranes which have been heat welded together along their respective outer edges so as to form a common joint, first and second portions of the paired membranes being mechanically fastened, proximate with this common joint, to the roof deck and to the parapet wall, respectively.

Not only can the inflatable barrier system according to the present invention be used to redirect water away from low spot(s) covered by membrane(s) 11 on a generally flat roof deck 38 but also the system's membrane 11 can be positioned so that it covers recessed area(s) 10 in a low-pitch roof 40, where the recessed area(s) are situated next to one or more parapet walls 41, 42 bounding the roof's outer edges (FIGS. 2 and 6). Indeed, the inflatable barrier system can be fitted onto a wide variety of complex angular structures including one where the system functions as a "corner cricket" and is located at the juncture between one of the parapet's corners and the roof deck 40 (FIG. 2). This high degree of flexibility in the choice of configuration for the inflatable barrier system allows an installer to use such system(s) to effectively elevate recessed area(s) wherever they may be found next to a parapet wall and divert water away from them to a nearby scupper 31.

Means for mechanically fastening the membrane 11, once it has been heat welded proximate with its outer periphery to either a compatible roof covering 20 or to a second membrane 12, or has been joined to the roof covering with the use of a double-sided butyl tape or with one or more adhesives, glues, solvents or like, preferably includes a mounting bracket with galvanized plates 19, each of which is affixed to at least one screw-like fastener 16 (FIGS. 1, 3~5). Alternatively, the mounting bracket, plates 19 and fasteners 16 can be made from aluminum or stainless steel. The mounting bracket itself may have interlocking components 25, 26; 35, 36 between which the outer edges of paired membranes 11, 12 are pressed firmly together (FIGS. 3 and 4).

In an alternate embodiment, an elongated galvanized plate 15 is employed to press the outer edges of membranes 11, 12 against each other, sandwiching them between the plate and the roof deck's covering 20 with the use of fasteners 16 (FIG. 6).

In a still further embodiment, a plurality of generally circular plates 19 with fasteners 16 which are spaced apart from each other at approximately 1 foot intervals is used to press amounting bracket against the outer edges of membrane 11, thus affixing these edges to a roof deck (FIG. 1).

A cover strip 18, made of a heat sealable material, is preferably utilized to protect the mechanical fasteners as they hold the inflatable barrier system in place on either a roof deck 38 or a roof deck 40 in combination with a parapet wall. The strip 18 is preferably affixed along its outer edges to both the membrane 11 and the roof covering 20 so as to form airtight seals with both.

It is claimed:

1. In combination with a heat weldable, thermoplastic roof covering affixed to a generally flat roof, the roof having a roof deck which supports the roof covering and at least one layer of roofing material which is disposed adjacent to the roof covering and which underlies it, said layer defining at least one naturally-occurring recessed area, the roof covering extending downwardly and inwardly from the recessed area's edges to form an upwardly-facing cavity, the improvement which comprises:

(a) an air impermeable, sheet-like membrane and a charging valve mounted thereon and joined thereto so as to form a first airtight seal, the first airtight seal being disposed about the valve and between the valve and the membrane;

(b) portions of the membrane which overlap the recessed area's edges being heat welded to the thermoplastic roof covering in such a way as to form a second airtight seal, the second airtight seal being disposed outwardly of the recessed area and extending in a continuous loop around the recessed area's perimeter;

(c) the membrane with the charging valve so joined thereto and the roof covering, when the membrane is so heat welded thereto, defining an airtight member bounded by the second airtight seal; and (d) means, including the charging valve which, in use, fluidly communicates with the airtight member, for inflating the airtight member; the membrane, when the airtight member is sufficiently inflated, protruding generally upwardly so as to form a substantial bulge which spans that part of the roof covering which forms the upwardly-facing cavity as well as portions of the roof covering which, while they are situated outwardly from the recessed area's edges, are disposed inwardly of the second airtight seal, so that storm water which would otherwise pool in the upwardly-facing cavity is directed away from it.

2. An inflatable barrier system adapted to cover at least one of a generally flat roof's recessed areas, the recessed area having at least one upwardly-facing surface which slopes downwardly at a shallow incline to the horizontal, which comprises:

(a) at least one pair of first and second sheet-like membranes, each membrane having been fabricated from an air impermeable, heat weldable, thermoplastic material, each membrane in the pair being individually sized and shaped to both cover at least one recessed area and substantially overlap its edges;

(b) an air valve mounted on the first membrane and joined thereto so as to form a first airtight seal, the first airtight seal being disposed about the valve and between the valve and the first membrane;

(c) the first and second membranes being heat welded together in such a way as to form a second airtight seal which joins the two membranes and extends in a continuous loop proximate with the first membrane's perimeter, the first membrane, with the air valve joined thereto, and the second membrane, when the first membrane has been so heat welded thereto, defining an airtight member bounded by the second airtight seal;

(d) means for mechanically fastening the first membrane, outwardly from the second airtight seal, to the roof deck;

(e) means, including the air valve which, in use, fluidly communicates with the airtight member, for inflating the airtight member;

(f) the second membrane having first and second portions which are disposed inwardly of the second airtight seal, the first portion, when the airtight member is sufficiently inflated, being disposed downwardly of the recessed area's edges, and the second portion being situated outwardly from said edges; and (g) the first membrane, when the airtight member is sufficiently inflated, protruding generally upwardly so as to form a substantial bulge which spans both the first and second portions of the second membrane, so that any storm water which would otherwise pool in the recessed area is directed away from it.

3. A method for directing stormwater captured on a generally flat or low-pitch roof, which has at least one naturally-occurring recessed area, away from it and towards the roof's drains or scuppers, which comprises the steps of:

(a) cutting a pair of first and second sheet-like membranes fabricated from an air impermeable, heat weldable, thermoplastic material, each membrane in the pair being individually sized and shaped to both cover the recessed area and overlap its edges;

(b) mounting an air valve on the first membrane and, in the process, forming a first airtight seal, the first airtight seal being disposed about the valve and between the valve and the first membrane;

(c) heat welding the first and second membranes together to form a second airtight seal which extends in a continuous loop proximate with the first membrane's perimeter, the first membrane, with the air valve so joined thereto, and the second membrane, with the first membrane so heat welded thereto, defining an airtight member disposed inwardly of the second airtight seal;

(d) mechanically fastening the first and second membranes, at points thereon disposed outwardly from the second airtight seal, to the roof deck; and (e) inflating the airtight member with a suitable gas introduced into the airtight member through the air valve which, in use, fluidly communicates with it; the airtight member being so inflated to such an extent that simultaneously the first membrane protrudes generally upwardly from the recessed area's edges and first and second portions of the second membrane are, respectively, pressed downwardly into the recessed area and pulled taut between its edges and the airtight seal, the upwardly protruding first membrane forming an overarching bulge above the recessed area, said bulge spanning both the first and second portions of the second membrane, thereby sealing the recessed area's edges against water which might otherwise gain access, beneath the bulge's outer periphery, to the recessed area.

4. The method according to claim 3, which further comprises the step of maintaining a constant air pressure within the airtight member, thereby preventing the first membrane's collapse onto the roof on a long-term basis.

5. The method according to claim 3, wherein the suitable gas used to inflate the airtight member is nitrogen, which, utilized in place of compressed air, enhances the life span of the first and second membranes.

* * * * *